US011247475B2

(12) United States Patent
Nanjo et al.

(10) Patent No.: US 11,247,475 B2
(45) Date of Patent: Feb. 15, 2022

(54) LIQUID COLLECTING DEVICE AND LIQUID COLLECTING AND FILLING SYSTEM

(71) Applicant: CANON KABUSHIKI KAISHA, Tokyo (JP)

(72) Inventors: Tatsuo Nanjo, Kawasaki (JP); Yuji Tamaru, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 16/937,448

(22) Filed: Jul. 23, 2020

(65) Prior Publication Data

US 2021/0031531 A1 Feb. 4, 2021

(30) Foreign Application Priority Data

Jul. 30, 2019 (JP) ..... JP2019-139477
Jun. 24, 2020 (JP) ..... JP2020-108914

(51) Int. Cl.
*B41J 2/17* (2006.01)
*B41J 2/14* (2006.01)
*B41J 2/175* (2006.01)

(52) U.S. Cl.
CPC ..... *B41J 2/1721* (2013.01); *B41J 2/175* (2013.01); *B41J 2002/14306* (2013.01)

(58) Field of Classification Search
CPC ..... B41J 2/1721; B41J 2/175; B41J 2002/14306; B41J 2002/1856; B41J 2/17509; B41J 2/1754
USPC ..... 347/36
See application file for complete search history.

(56) References Cited

U.S. PATENT DOCUMENTS 6,079,823 A * 6/2000 Droege ..... B41J 2/17523 347/85
2001/0013884 A1* 8/2001 Crystal ..... B41J 2/17509 347/85
2007/0051421 A1* 3/2007 Sarnoff ..... B41J 2/17526 141/83

FOREIGN PATENT DOCUMENTS

JP 2007-313829 A 12/2007

* cited by examiner

*Primary Examiner* — Kristal Feggins
*Assistant Examiner* — Alexander D Shenderov
(74) *Attorney, Agent, or Firm* — Canon U.S.A., Inc. I.P. Division

(57) ABSTRACT

A liquid collecting device to collect liquid stored in a storage portion of a liquid container includes a bottle main body, a collecting joint portion, and a first valve element. A flow passage member of the liquid container ports the liquid to the storage portion. The bottle main body has first and second openings in communication with outside the liquid collecting device. The collecting joint portion connects to the bottle main body through the first opening and includes a first coupling portion coupled to the flow passage member, and an internal flow passage extending between the first opening and the first coupling portion. The internal flow passage includes a throttle portion and a space. The first valve element is moveably provided in the space and the first valve element has an area larger than an opening area of the first opening and an opening area of the throttle portion.

9 Claims, 16 Drawing Sheets

LIQUID COLLECTING DEVICE AND LIQUID COLLECTING AND FILLING SYSTEM

BACKGROUND

Field

The present disclosure relates to a liquid collecting device and a liquid collecting and filling system.

Description of the Related Art

As an example of an image forming apparatus configured to form an image on a recording medium, there has been known an ink jet printer employing a system called an off-carriage system (also called tube system). In the ink jet printer employing the off-carriage system, as the basic structure, a recording head including a sub-tank is mounted to a carriage, and a liquid tank is installed and arranged in a stationary manner on a main body of the image forming apparatus. Further, the recording head (sub-tank) and the liquid tank are coupled to each other by a tube, and ink is supplied through the tube. In general, the image forming apparatus is installed and used at a predetermined place. However, after the start of use, in some cases, it is required to transport the image forming apparatus to another installation place (such transport is hereinafter is referred to as "secondary transport") for the purpose such as changing layout or moving to another location. When the secondary transport of the ink jet printer employing the off-carriage system is performed under a state in which a large amount of liquid is filled in the liquid tank, the liquid may leak from, for example, the liquid tank itself or a connection portion of the tube through which the liquid is supplied to the recording head. In order to reliably prevent the leakage of the liquid, it is desired to transport the image forming apparatus after the liquid tank is emptied. In Japanese Patent Application Laid-Open No. 2007-313829, there is disclosed a method of collecting liquid in a sub-tank provided below a main tank in a gravity direction. Specifically, a liquid collecting tube is connected to a liquid collecting container provided below the sub-tank in the gravity direction, and the liquid in the sub-tank is collected in the liquid collecting container owing to a water head difference.

However, in the technology described in Japanese Patent Application Laid-Open No. 2007-313829, when the connection between the liquid collecting tube and the liquid collecting container is incomplete, there may be a fear in that the liquid in the sub-tank is not satisfactorily collected. In this case, the liquid is left in the sub-tank. Therefore, it is difficult to sufficiently prevent the leakage of the liquid at the time of the secondary transport.

SUMMARY

Disclosed is a liquid collecting device and a liquid collecting and filling system, which are capable of more reliably preventing leakage of liquid at the time of collection of the liquid and safely performing secondary transport while minimizing the liquid left in a sub-tank.

According to an aspect of the present disclosure, a liquid collecting device configured to collect liquid stored in a storage portion of a liquid container, wherein the liquid collecting device is connected to the liquid container, which includes a flow passage member configured to allow the liquid to be filled into the storage portion, includes: a bottle main body having an elastic restoration force and having first and second openings configured to be in communication with an outside of the liquid collecting device, a collecting joint portion connected to the bottle main body through the first opening, wherein the collecting joint portion includes a first coupling portion configured to be coupled to the flow passage member, and includes an internal flow passage extending between the first opening and the first coupling portion, wherein the internal flow passage includes a throttle portion and a space defined between the first opening and the throttle portion, and a first valve element provided in the space so as to be movable in a flowing direction of the liquid, wherein the first valve element has a first area larger than an opening area of the first opening and an opening area of the throttle portion.

Further features of the present disclosure will become apparent from the following description of exemplary embodiments with reference to the attached drawings.

DESCRIPTION OF THE EMBODIMENTS

Figure 1:
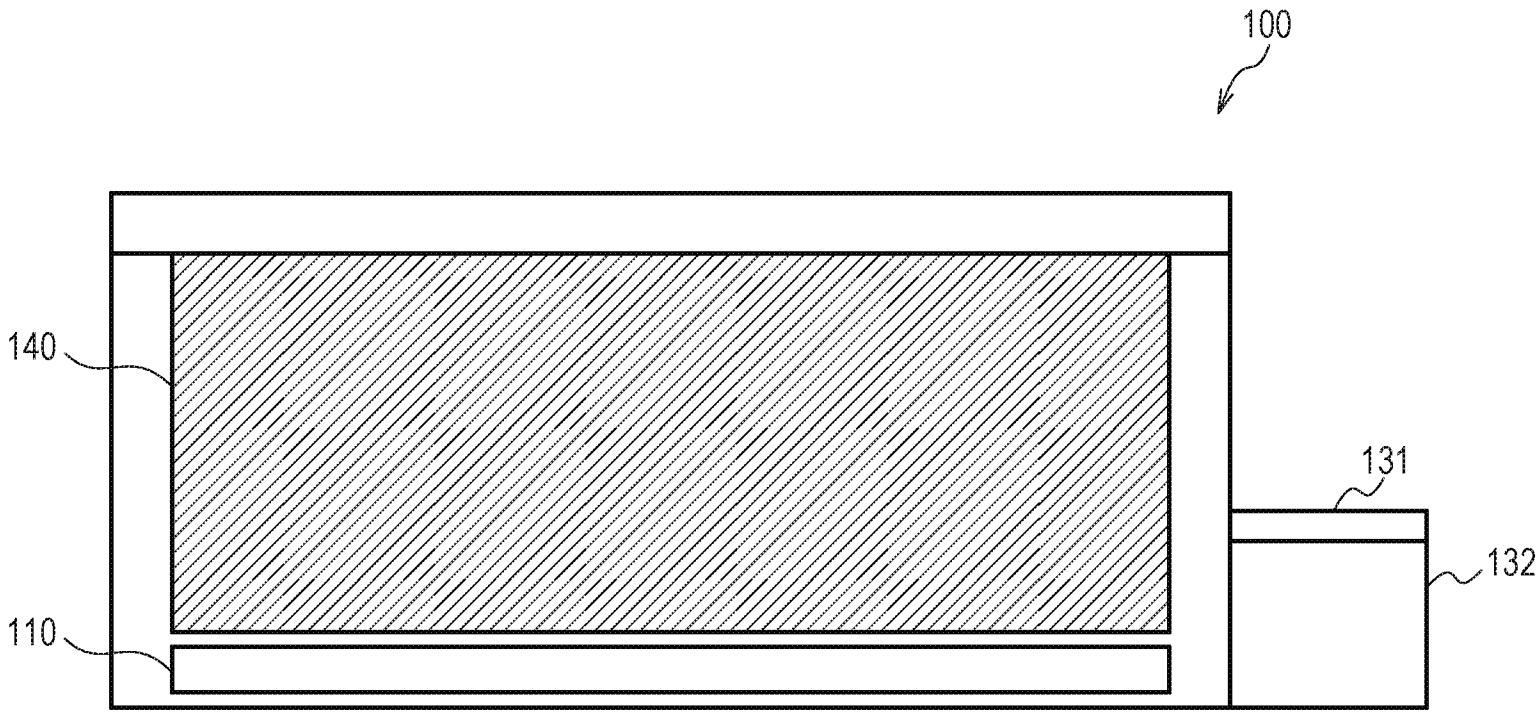
FIG. 1 is a front view for schematically illustrating an external appearance of an image forming apparatus.

Now, a liquid collecting device according to one embodiment of the present disclosure is described with reference to the drawings. In each embodiment described below, description is made of a specific configuration of a liquid collecting device to be used for an ink jet recording apparatus including a recording head configured to eject ink that is an example of liquid. However, the present disclosure is not limited to this configuration. The liquid collecting device according to the present disclosure is applicable to apparatus such as a printer, a copying machine, a facsimile machine including a communication system, and a word processor including a printer unit, and to an industrial recording apparatus including various kinds of processing devices compositely combined with each other. The liquid collecting device according to the present disclosure is applicable to and usable for, for example, a biochip manufacturing apparatus and electronic circuit printing.

Further; each embodiment described below is one embodiment to which the present disclosure is applied, and hence various limitations, which are technically preferred, are given to each embodiment. However, as long as each embodiment is carried out in accordance with the technical idea of the present disclosure, the present disclosure is not limited to the embodiment described in the specification and other specific methods. In the following description, components having the same function are denoted by the same reference symbols in the drawings, and description of overlapping matters is omitted.

(Ink Jet Recording Apparatus)

Figure 2:
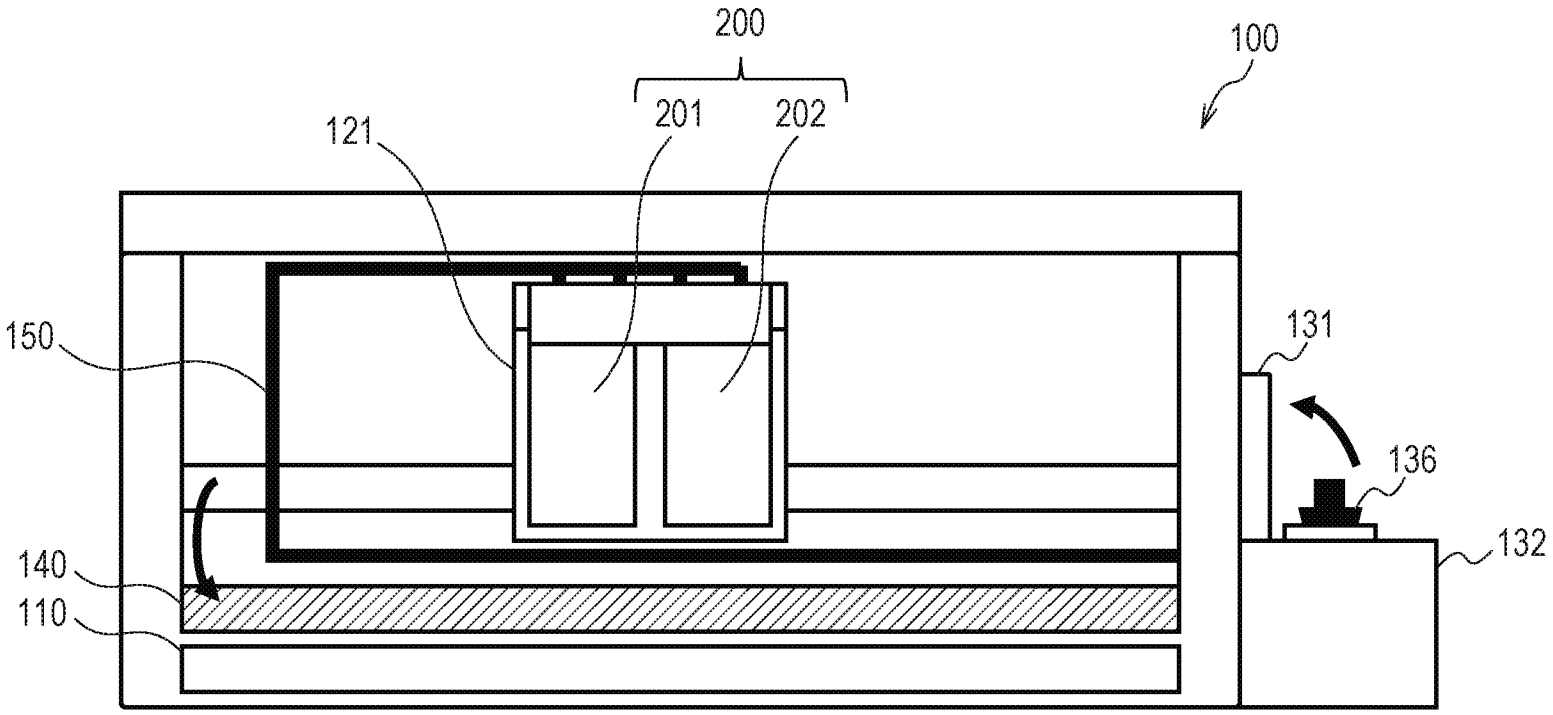
FIG. 2 is a front view for schematically illustrating the external appearance of the image forming apparatus when a front cover and a tank cover are opened.

Prior to description of the liquid collecting device according to one embodiment of the present disclosure, an ink jet recording apparatus that uses the liquid collecting device is briefly described with reference to FIG. 1 and FIG. 2, FIG. 1 is a front view for schematically illustrating an external appearance of an ink jet recording apparatus 100 seen from a sheet delivery portion 110 side. FIG. 2 is a front view for schematically illustrating the external appearance of the ink jet recording apparatus 100 seen from the sheet delivery portion 110 side when a front cover 140 and a main tank cover 131 of the ink jet recording apparatus 100 of FIG. 1 are opened.

As illustrated in FIG. 1, the ink jet recording apparatus 100 includes at least a main tank 132 (storage portion), the main tank cover 131, the front cover 140, and the sheet delivery portion 110. The main tank 132 is a liquid container configured to store ink to be filled into a cartridge 200 (FIG. 3) described later. When an image is formed through use of the ink jet recording apparatus 100, normally, the main tank cover 131 is in a closed state as illustrated in FIG. 1. The front cover 140, which is provided at a front of the ink jet recording apparatus 100, forms part of a casing of the ink jet recording apparatus 100. The front cover 140 is closed under a normal use state, and is opened when any abnormalities (for example, replacement of an ink cartridge and sheet jam) occur in the ink jet recording apparatus 100. The sheet delivery portion 110 is provided at a lower portion of the front of the ink jet recording apparatus 100, and is configured to deliver a sheet having an image formed thereon to an outside of the ink jet recording apparatus 100. In the case of FIG. 1, the sheet having the image formed thereon is delivered in a direction directed to a front side of the drawing sheet of FIG. 1. In the description of the present disclosure, a paper sheet is exemplified as the recording medium, but the recording medium is not limited to the paper sheet.

Figure 3:
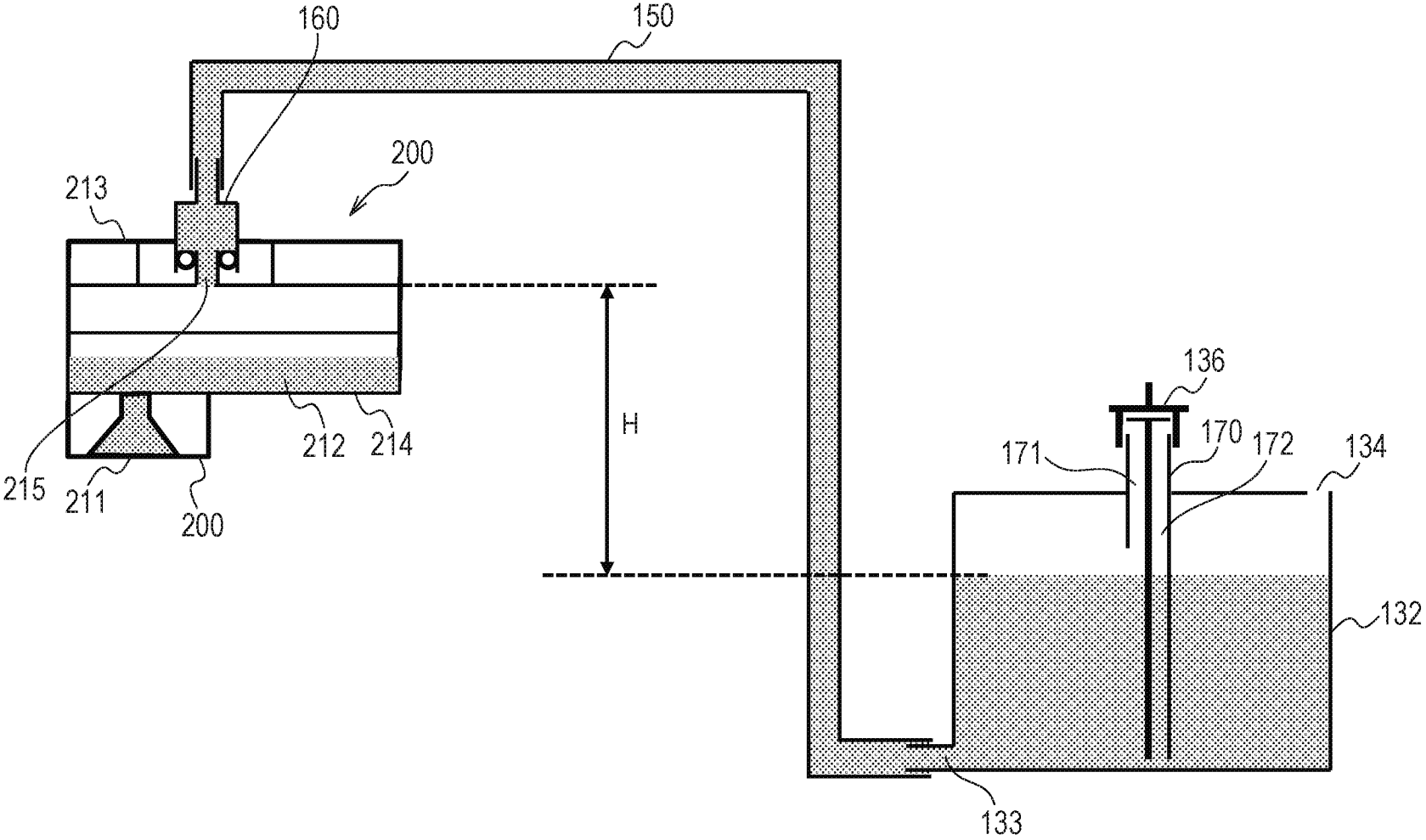
FIG. 3 is a view for schematically illustrating a liquid supply system of the image forming apparatus.

As illustrated in FIG. 2, the ink jet recording apparatus 100 includes at least a carriage 121 and an ink cartridge 200. The carriage 121 is provided inside the ink jet recording apparatus 100, and is reciprocated for scanning in a main scanning direction (right-and-left direction of FIG. 2) so as to form an image on the recording medium. The ink cartridge 200 is mounted to the carriage 121, and is configured to supply the ink to a recording head 211 (FIG. 3). The ink to be used by the ink cartridge 200 so as to form the image is filled into the main tank 132 provided on a left side (right side of FIG. 1 or FIG. 2) of a main body of the ink jet recording apparatus 100. The main tank 132 and the ink cartridge 200 are coupled to each other by a tube 150.

In FIG. 2, the front cover 140 is opened by being pulled in a direction directed to a front side of the drawing sheet of FIG. 2 as indicated by the arrow, and the main tank cover 131 is opened by being pivoted in a counterclockwise direction as indicated by the arrow. In FIG. 2, an ink cartridge 201 for black and an ink cartridge 202 for three colors, that is, cyan, magenta, and yellow are mounted to the carriage 121, In FIG. 2, a case in which the ink cartridge 202 for colors is formed of one ink cartridge is exemplified. However, the ink cartridge 202 for colors may be formed of different cartridges for cyan, magenta, and yellow. In a case of the ink jet recording apparatus 100 illustrated in FIG. 2, the carriage 121 is reciprocated for scanning in the right-and-left direction of FIG. 2, and the ink is ejected from the recording head 211 (FIG. 3). In this manner, an image is formed on the recording medium exemplified by the sheet, and the recording medium is delivered from the sheet delivery portion 110. A method of supplying the ink to the recording head 211 and a method of filling the ink into the main tank 132 are described later.

Next, components of the ink jet recording apparatus 100 are described in detail with reference to FIG. 3. FIG. 3 is a view for illustrating a standby state of an ink supply system when the ink jet recording apparatus 100 does not form an image. With reference to FIG. 3, description is made of a case in which the ink is supplied from the main tank 132 to the ink cartridge 201 for black, but the same applies also to a case in which the ink is supplied from the main tank 132 to the ink cartridge 202 for colors. In the following description, the ink cartridge 201 for black and the ink cartridge 202 for colors are collectively referred to as the ink cartridge 200.

(Ink Cartridge)

The ink cartridge 200 is mounted to the recording head 211 configured to eject the ink. An absorber 212 configured to absorb the ink is provided inside the ink cartridge 200. The absorber 212 retains the ink supplied from the main tank 132, and generates negative pressure with respect to the recording head 211. This configuration is adopted to prevent leakage of the ink from the recording head 211 before the ink cartridge 200 is mounted to the recording head 211. A lid member 213 is provided on an upper surface portion of the ink cartridge 200. The lid member 213 and a tank case 214 are welded to each other, thereby defining a boundary between an inside and an outside of the ink cartridge 200.

An ink introduction port 215 is formed in the lid member 213. The ink introduction port 215 is coupled to a joint member 160 provided on one end side of the tube 150. The ink introduction port 215 extends in a tubular shape from a position shifted downward by a predetermined length from a position at which the introduction port 215 is coupled to the joint member 160. When an image is formed by the ink jet recording apparatus 100 and the ink in the recording head 211 is consumed, under a state in which the ink introduction port 215 and the joint member 160 are coupled to each other, the ink is filled into the ink cartridge 200 from the main tank 132 via the tube 150 and the joint member 160.

(Main Tank)

A liquid drawing port 133 is formed in an end portion of a bottom surface of the main tank 132 having an internal space into which the ink can be filled. The liquid drawing port 133 serves as a portion communicating with the outside of the main tank 132. The liquid drawing port 133 is coupled to the tube 150, and the ink filled into the main tank 132 is fed through the liquid drawing port 133 into the tube 150. An atmosphere communicating port 134 is formed in a right end of an upper surface portion of the main tank 132. Through the atmosphere communicating port 134, the air in the atmosphere is taken in by an amount corresponding to a decrease in the ink in the main tank 132. Further, an ink filling pipe 170 is provided at a center of the upper surface portion of the main tank 132. The ink filling pipe 170 is an example of a flow passage member in which two flow passages, that is, an air flow passage 171 and a liquid flow passage 172 are formed. The liquid flow passage 172 is formed to extend from the upper surface of the main tank 132 to a vicinity of the bottom surface of the main tank 132. The air flow passage 171 is formed to extend from the upper surface of the main tank 132 to a vicinity of an upper portion of the main tank 132. The ink filling pipe 170 is configured to fill the ink from an ink bottle 500 (FIG. 4), which is described later, into the main tank 132 by being coupled to the ink bottle 500. A method of filling the ink from the ink bottle 500 into the main tank 132 is described later. While the ink jet recording apparatus 100 forms an image and is in an image forming standby state, the air flow passage 171 and the liquid flow passage 172 are sealed by a rubber stopper 136.

(Tube)

The tube 150 forms an ink path extending from the main tank 132 to the ink cartridge 200. One end side of the tube 150 is coupled to the main tank 132, and another end side of the tube 150 is coupled to the joint member 160. The tube 150 is required to have an air barrier property and a water-vapor barrier property. Thus, as a material for the tube 150, a styrene-based elastomer is adopted in the embodiments of the present disclosure.

(Method of Supplying Ink to Ink Cartridge)

Next, a method of supplying the ink to the ink cartridge is described. As illustrated in FIG. 3, a liquid surface of the ink in the main tank 132 is located below a lower surface portion of the recording head 211 in a gravity direction. The atmosphere communicating port 134, through which the air in the atmosphere is taken in, is formed in the right end of the upper surface portion of the main tank 132. Thus, atmospheric pressure is applied to the inside of the main tank 132. In contrast, negative pressure is generated in the ink in the tube 150 owing to a water head difference corresponding to a height indicated by the bidirectional arrow H of FIG. 3. Therefore, a force of the ink in the tube 150 flowing to the main tank 132 side, and a capillary force of the absorber 12 are balanced, thereby preventing leakage of the ink from the recording head 211.

When an image is formed by the ink jet recording apparatus 100 and the ink is ejected from the recording head 211, an amount of the ink in the ink cartridge 200 is reduced by an amount corresponding to an amount of the ejected ink. When the amount of the ink in the ink cartridge 200 is reduced, the negative pressure applied to the inside of the ink cartridge 200 is further increased. Accordingly, the balance between the negative pressure and the capillary force of the absorber 212 is lost. In order to keep this balance, an amount of the ink corresponding to a decrease in the ink in the ink cartridge 200 is supplied (replenished) through the ink introduction port 215 into the ink cartridge 200, thereby reducing the negative pressure in the ink cartridge 200. Through repetition of this operation, the ink is supplied to the ink cartridge 200.

(Method of Filling Ink into Main Tank)

Figure 4:
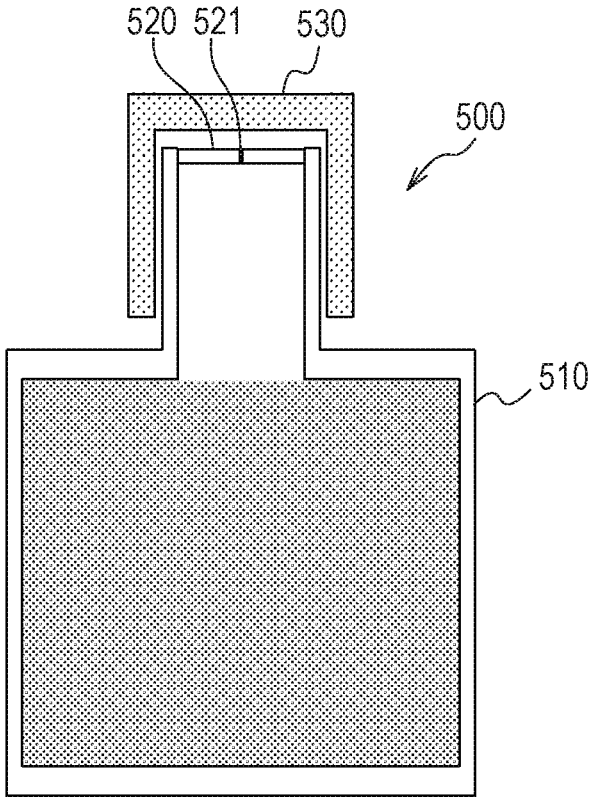
FIG. 4 is a view for schematically illustrating a cross section of a liquid filling bottle configured to fill liquid into a main tank.
Figure 5:
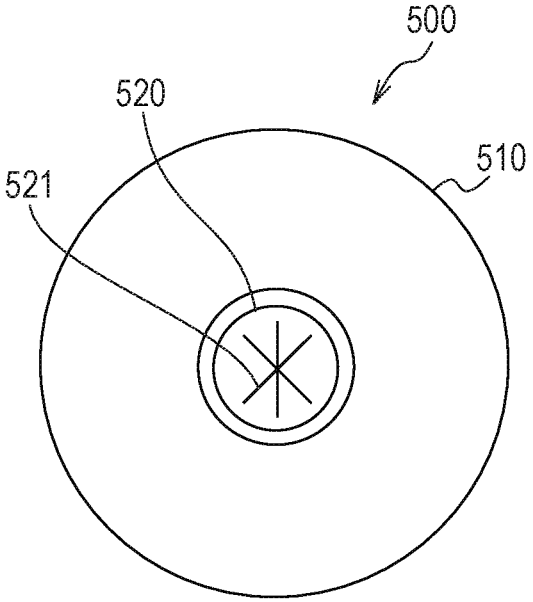
FIG. 5 is a view for schematically illustrating an upper surface of the liquid filling bottle configured to fill the liquid into the main tank.

Next, a method of filling the ink into the main tank 132 is described with reference to FIG. 4 to FIG. 6. As illustrated in FIG. 4, the ink bottle 500 includes a bottle container 510, a joint rubber member 520 being an example of a sealing member, and a cap 530. When the ink is filled into the main tank 132, the cap 530 is removed from the ink bottle 500, and the ink bottle 500 is inverted. Then, the joint rubber member 520 is coupled to the ink filling pipe 170 of the main tank 132 such that the joint rubber member 520 is arranged on a lower side of the ink bottle 500 in the gravity direction. As illustrated in FIG. 5, a slit (cut) 521 having an asterisk shape is formed in the joint rubber member 520 of the bottle container 510. The ink filling pipe 170 can be inserted into the ink bottle 500 through the slit 521. The slit 521 is formed to be extremely narrow, and hence a meniscus force acts. Therefore, the ink in the ink bottle 500 does not easily leak downward (to the main tank 132 side) through the slit 521.

Figure 6:
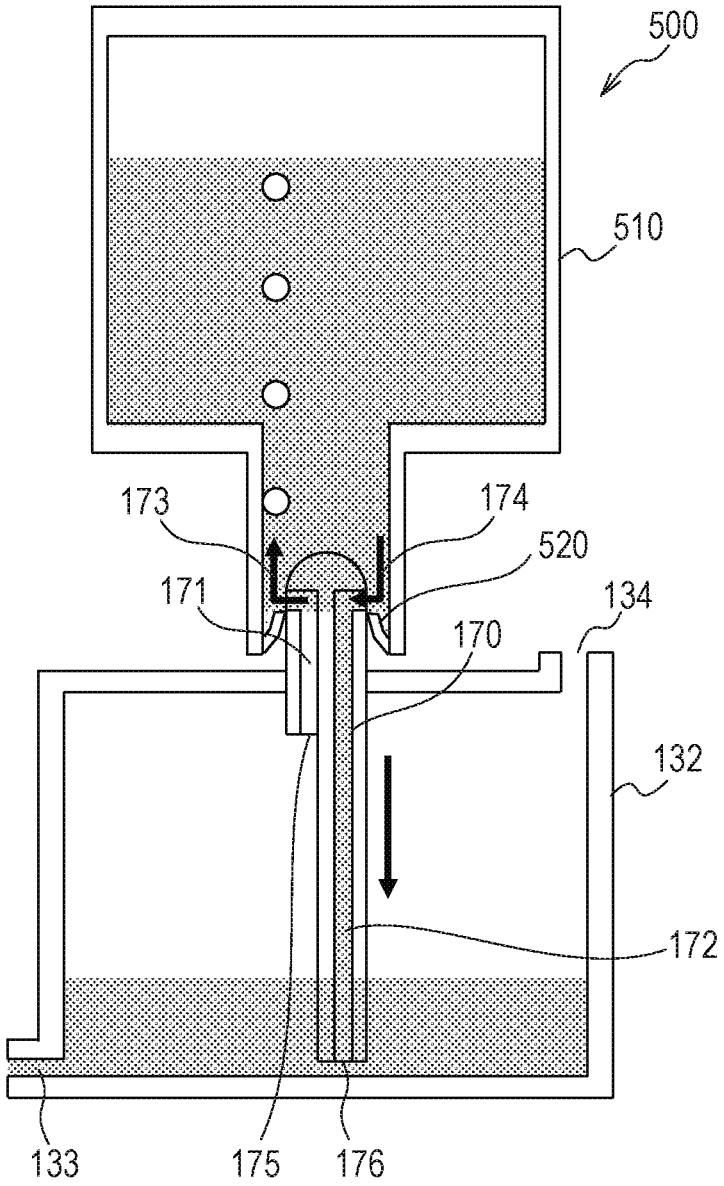
FIG. 6 is a schematic view for illustrating a state in which the liquid filling bottle is mounted to the main tank so as to fill the liquid.

As illustrated in FIG. 6, the ink filling pipe 170 of the main tank 132 and the bottle container 510 are coupled to each other in such a manner that the ink filling pipe 170 of the main tank 132 is inserted into the slit 521 so as to push and open the slit 521 of the joint rubber member 520 of the bottle container 510. Under the coupled state, a gap between the ink filling pipe 170 and the joint rubber member 520 is small, and hence the meniscus force acts also in the gap. Therefore, the ink does not leak from the bottle container 510 to the outside of the main tank 132. When the ink bottle 500 is thus inverted, and when the bottle container 510 and the ink filling pipe 170 are thus coupled to each other, the ink does not leak from the ink bottle 500. It is preferred that the slit 521 formed in the joint rubber member 520 have the asterisk shape as illustrated in FIG. 5. However, as long as the above-mentioned meniscus force acts and the ink does not leak from the ink bottle 500, the slit 521 may have any shape.

When the bottle container 510 and the ink filling pipe 170 of the main tank 132 are coupled to each other, as indicated by the arrow 173 of FIG. 6, the air in the main tank 132 flows into the ink bottle 500 through the air flow passage 171. Then, as indicated by the arrow 174, the ink in the ink bottle 500 corresponding to an amount of the air having flowed from the main tank 132 into the ink bottle 500 passes through the liquid flow passage 172 and flows into the main tank 132 through a lower opening 176. When such gas-liquid replacement supply is performed through replacement of gas by liquid through the ink filling pipe 170, the ink is filled into the main tank 132.

When the liquid surface of the ink in the main tank 132 reaches a position of a lower opening 175 of the air flow passage 171, the lower opening 175 of the air flow passage 171 is covered with the ink. Accordingly, the air cannot flow from the main tank 132 to the ink bottle 500, and filling of the ink from the ink bottle 500 into the main tank 132 is stopped. In this manner, filling of a predetermined amount of the ink into the main tank 132 essentially out of user's awareness.

First Embodiment

Figure 7:
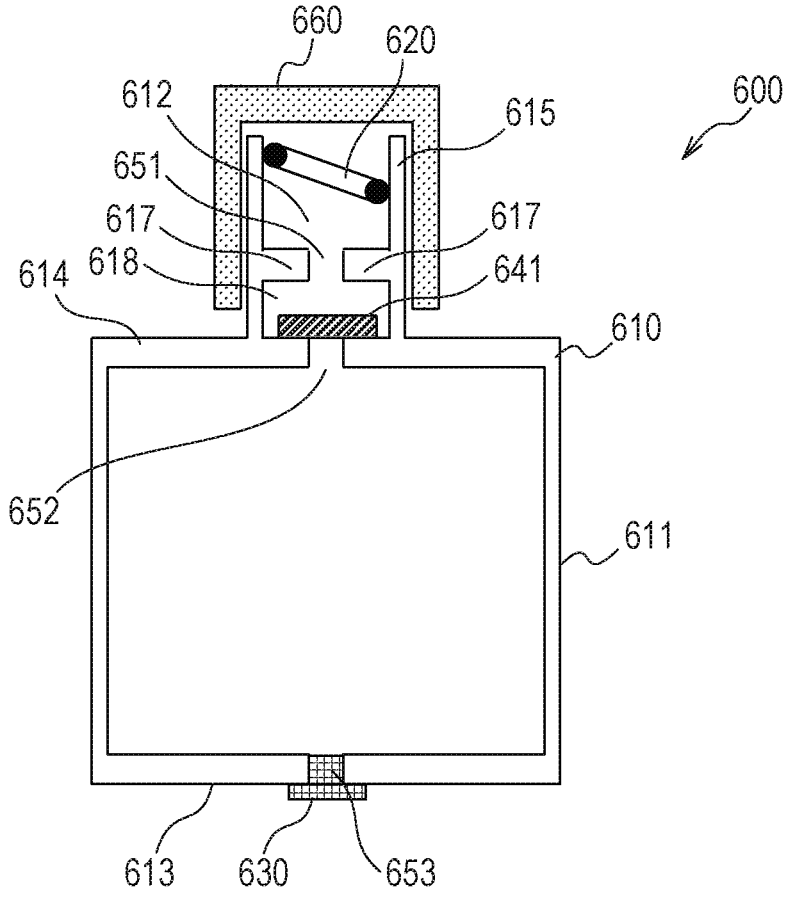
FIG. 7 is a view for schematically illustrating a cross section of a liquid collecting bottle in a first embodiment.

Next, an ink collecting bottle being an example of the liquid collecting device according to a first embodiment is described with reference to FIG. 7. FIG. 7 is a sectional view for illustrating an ink collecting bottle 600.

(Ink Collecting Bottle)

As illustrated in FIG. 7, the ink collecting bottle 600 includes an ink container 610 having a cylindrical shape and a cap 660. The ink container 610 includes a body portion 611, a bottom portion 613, an upper surface portion 614, and a joint unit portion 615. A joint opening portion 612 and a fourth opening 651 are formed in the joint unit portion 615. The joint opening portion 612 is a portion in which the ink filling pipe 170 is to be inserted. The joint unit portion 615 is a coupling portion configured to couple the ink collecting bottle 600 and the ink filling pipe 170 to each other. An O-ring 620 made of rubber is provided in the joint opening portion 612. The O-ring 620 is arranged in the joint opening portion 612 so as to be inclined with respect to a horizontal direction. In a case of FIG. 7, the O-ring 620 is inclined downward to a right side thereof. With this configuration, when the ink collecting bottle 600 and the main tank 132 are coupled to each other, of the air flow passage 171 and the liquid flow passage 172 formed in the ink filling pipe 170 of the main tank 132, only the air flow passage 171 can be closed. This point is described later.

The above-mentioned arrangement of the O-ring is a configuration which is effective when an upper opening 177 of the air flow passage 171 and an upper opening 178 of the liquid flow passage 172 of the ink filling pipe 170 are at the same position in a height direction. For example, when the upper opening 177 of the air flow passage 171 and the upper opening 178 of the liquid flow passage 172 of the ink filling pipe 170 are at different positions in the height direction, the O-ring 620 may be arranged in any posture as long as the O-ring 620 is arranged at a position of being capable of closing the upper opening 177 of the air flow passage 171 so as to allow the ink to be collected. Further, when the structure of the ink filling pipe 170 is different from the structure in the first embodiment, in addition to the O-ring for sealing, which is configured to prevent leakage of the ink through the coupling portion, a member for sealing may be separately arranged at a position of being capable of closing the upper opening 177 of the air flow passage 171 so as to allow the ink to be collected.

The fourth opening 651 is formed below the O-ring 620 in the joint unit portion 615. A first opening 652 is formed in the upper surface portion 614. An internal flow passage is formed between the first opening 652 and the joint unit portion 615 to extend between the first opening 652 and the joint unit portion 615. In the internal flow passage, there are provided a throttle portion 617 and a space 618 defined between the first opening 652 and the throttle portion 617. Those points are described later. A first valve element 641 configured to close the first opening 652 is provided at a bottom portion of the joint unit portion 615. The first valve element 641 is made of plastic having a specific gravity higher than that of the ink, and has an extremely thin disk shape. The first valve element 641 is provided so as to be movable in a flowing direction of the ink as described later. An area of the first valve element 641 is set to be larger than an opening area of the first opening 652 and an opening area of the throttle portion 617 described above. For example, with a configuration in which a diameter of the disk of the first valve element 641 is set to be larger than a diameter of the fourth opening 651 and a diameter of the first opening 652, the first valve element 641 is prevented from coming into the joint opening portion 612 or the ink container 610. A second opening 653 is formed in a center of the bottom portion 613, and an inside and an outside of the bottle communicate with each other through the second opening 653. The second opening 653 can be closed by a stopper 630. The cap 660 covers the entire joint unit portion 615, and a thread (screw thread) is formed on an inner side of the cap 660 so as to allow the cap 660 to be removably mounted to the joint unit portion 615. As described later, after the ink is collected from the main tank 132, the joint opening portion 612 can be hermetically sealed by the cap 660.

Here, a method of manufacturing the ink collecting bottle 600 is briefly described, First, the first valve element 641 having a diameter large enough to close the first opening 652 is put over the first opening 652 of the ink container 610. Then, the joint unit portion 615 is placed on and bonded to the ink container 610 such that a center of the joint unit portion 615 is aligned with a center of the upper surface portion 614 of the ink container 610, Finally, the O-ring 620 is inserted into the joint opening portion 612. An O-ring support portion (not shown) configured to support the O-ring 620 is formed in advance on the joint opening portion 612. The O-ring support portion is formed to allow the O-ring 620 to be placed in the joint opening portion 612 so as to be inclined downward to the right side of the O-ring 620 with respect to the horizontal direction.

The ink collecting bottle 600 is configured to collect the ink stored in the main tank 132 into the ink container 610, and store the ink in the ink container 610. The ink container 610 is a molded product made of a resin, and has an elastic restoration force. The ink container 610 has such rigidity as to be crushed when a user applies a pressing force by hand (such an action is hereinafter referred to as "squeeze"). Further, the ink container 610 has such a thickness as to obtain a restoration force of returning to an original shape after being squeezed.

(Ink Collecting Method)

Figure 8:
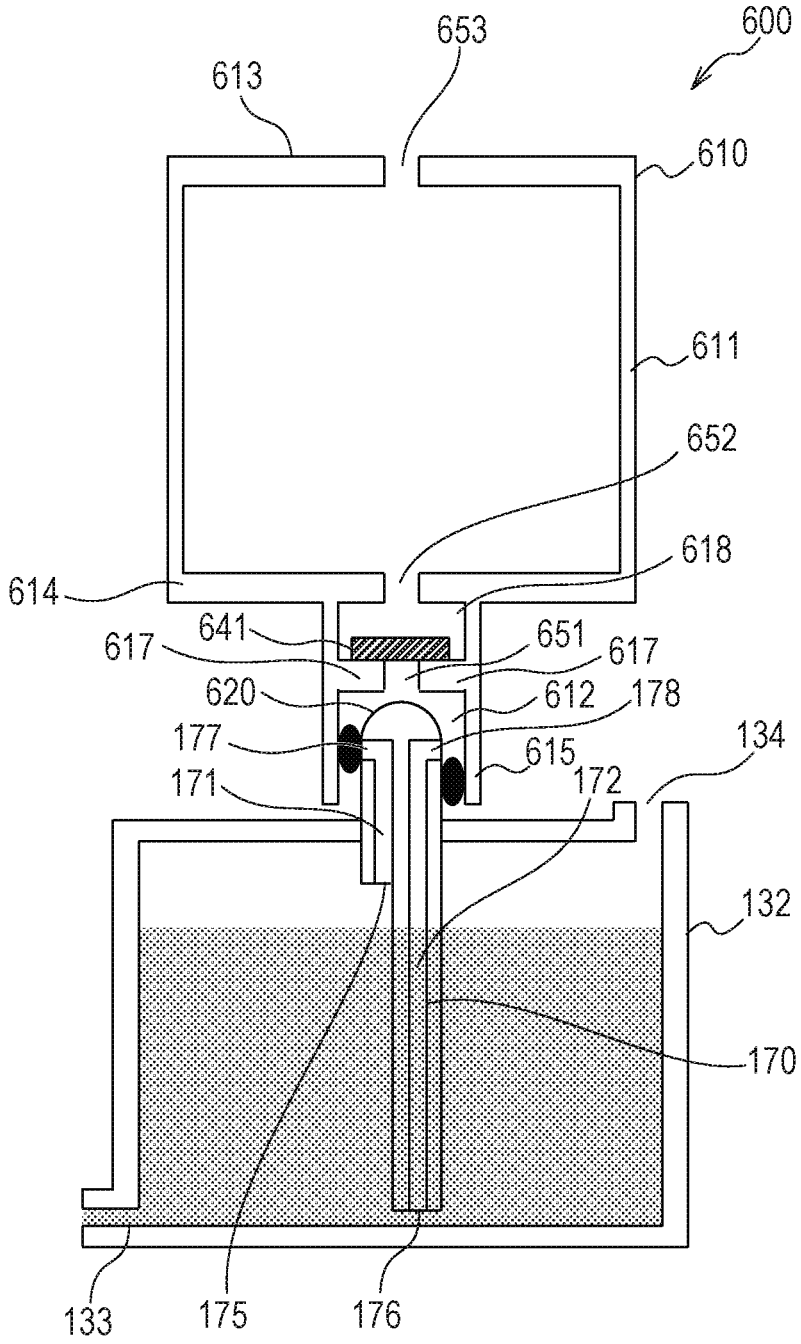
FIG. 8 is a schematic view for illustrating a state in which the liquid collecting bottle is mounted to the main tank so as to collect the liquid.
Figure 9:
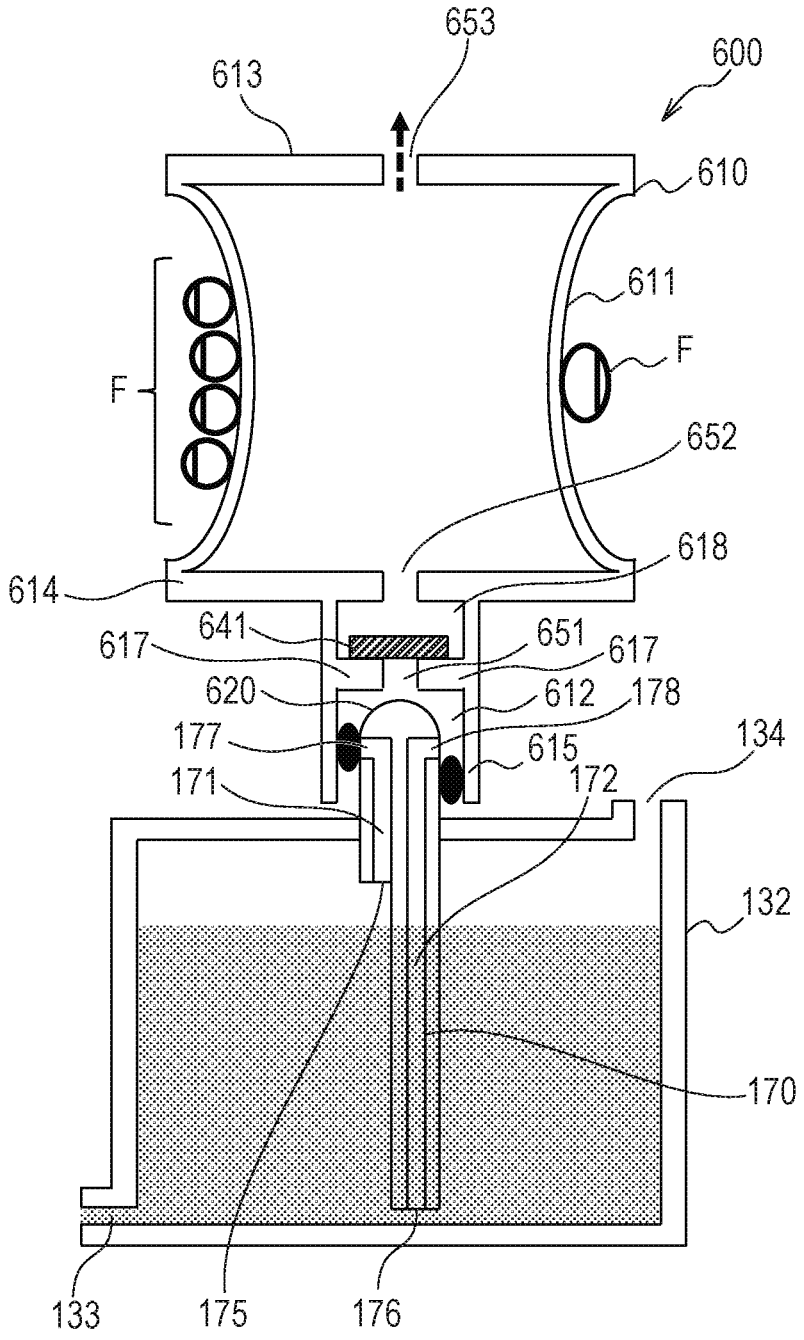
FIG. 9 is a schematic view for illustrating a state in which the liquid is collected from the main tank by squeezing side surfaces of the liquid collecting bottle.
Figure 10:
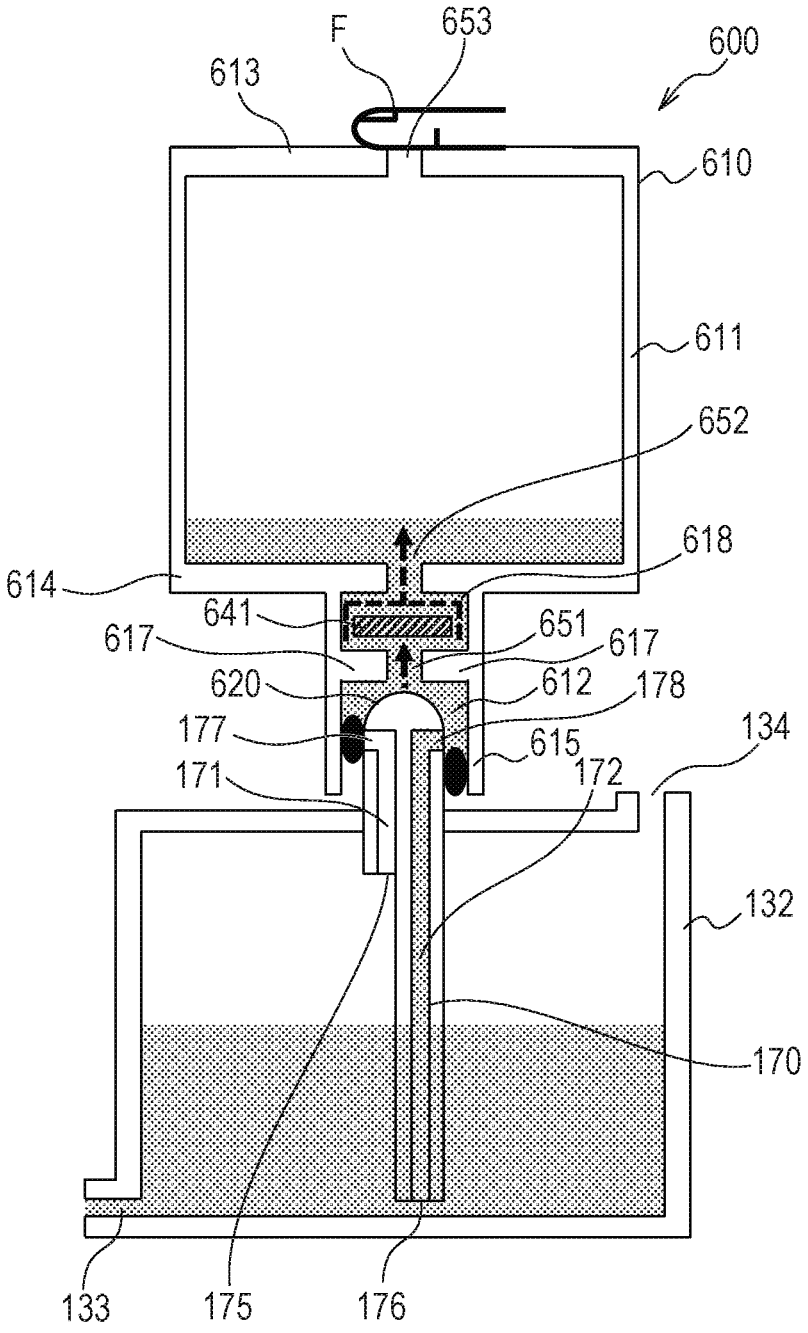
FIG. 10 is a schematic view for illustrating a state in which the liquid is collected after the liquid collecting bottle squeezed at the side surfaces returns to an original size.

Next, a method of collecting the ink through use of the ink collecting bottle 600 being an example of the liquid collecting device according to the first embodiment is described with reference to FIG. 8 to FIG. 10. FIG. 8 is a view for illustrating a state in which the ink collecting bottle 600 is mounted to the ink filling pipe 170 of the main tank 132. FIG. 9 is a view for illustrating a state in which the body portion 611 of the ink collecting bottle 600 is squeezed under the state illustrated in FIG. 8. FIG. 10 is a view for illustrating a state in which the body portion 611 of the ink collecting bottle 600 returns to the original shape through cancel of squeezing under the state illustrated in FIG. 9.

First, the cap 660 of the ink collecting bottle 600 is removed. Next, the stopper 630 is removed. Then, the ink collecting bottle 600 is inverted from the posture illustrated in FIG. 7, and the joint opening portion 612 is directed downward in the gravity direction so that the joint opening portion 612 and the ink filling pipe 170 of the main tank 132 are opposed to each other. The joint unit portion 615 of the ink collecting bottle 600 is arranged so as to surround an outer periphery of the ink filling pipe 170 of the main tank 132, and the ink collecting bottle 600 is pressed downward in the gravity direction. The ink collecting bottle 600 is mounted to the main tank 132 while causing the outer periphery of the ink filling pipe 170 and the O-ring 620 to slide.

As illustrated in FIG. 8, at a point in time when an upper end of the ink filling pipe 170 reaches a position in front of the fourth opening 651, a stopper device (not shown) is operated, and mounting of the ink collecting bottle 600 to the main tank 132 is completed. As described above, the O-ring 620 is arranged in the joint opening portion 612 so as to be inclined with respect to the horizontal direction (inclined downward to the right side thereof in the case of FIG. 8). That is, the O-ring 620 is provided so as to be inclined with respect to a center axis of the above-mentioned internal flow passage. Accordingly, the upper opening 177 of the air flow passage 171 is closed by a left end of the O-ring 620. In contrast, the upper opening 178 of the liquid flow passage 172 is opened without being closed by a right end of the O-ring 620. In the first embodiment, the O-ring 620 is exemplified as a member configured to close the upper opening 177 of the air flow passage 171 and keep the upper opening 178 of the liquid flow passage 172 open. However, any member may be adopted as long as the member has the same function as that of the O-ring.

Next, as illustrated in FIG. 9, a user squeezes the body portion 611 of the ink collecting bottle 600 with fingers F. When the user squeezes both side surfaces of the body portion 611 of the ink container 610 with the fingers F, the both side surfaces of the ink container 610 are squeezed so that an inner volume of the ink container 610 is reduced. At this time, gravity and pressure generated along with reduction in inner volume of the ink container 610 are applied to the first valve element 641 so that the first valve element 641 closes the fourth opening 651. Accordingly, along with reduction in inner volume after the ink container 610 is squeezed, the air in the ink collecting bottle 600 is vented only through the second opening 653. Therefore, along with reduction in inner volume after the ink container 610 is squeezed, the air in the ink collecting bottle 600 is released to the outside through the second opening 653.

Next, as illustrated in FIG. 10, when the user closes the second opening 653 with at least one finger F and releases the fingers F, with which the user squeezes the ink container 610, from the both side surfaces of the body portion 611 of the ink container 610, the both side surfaces of the body portion 611 of the ink container 610 return to the original shapes. The method of closing the second opening 653 is not limited to the method of closing the second opening 653 with at least one finger F. A lid member may be additionally provided for the ink instead. The both side surfaces of the body portion 611 of the ink container 610 return to the original shapes because the ink container 610 has the restoration force of returning to the original shape after being squeezed as described above. The main tank 132 has the atmosphere communicating port 134 through which the air in the atmosphere is taken in. Thus, the atmospheric pressure is applied to the inside of the main tank 132. In contrast, the second opening 653 is closed with at least one finger F of the user (or the lid, for example). Thus, the pressure applied to the inside of the ink container 610 is lower than the atmospheric pressure applied to the inside of the main tank 132 (negative pressure is generated). Therefore, there is a difference in pressure between the inside of the ink container 610 and the inside of the main tank 132, and as indicated by the dotted arrows, a force of raising the first valve element 641 slightly upward in the gravity direction is applied to the first valve element 641. That is, the first valve element 641 is moved in the flowing direction of the ink within, of the internal flow passage extending between the first opening 652 and the joint unit portion 615, the space 618 defined between the first opening 652 and the throttle portion 617. When the first valve element 641 is raised, a gap is defined between the first valve element 641 and the fourth opening 651. The ink in the main tank 132 passes through the liquid flow passage 172 and the upper opening 178 of the ink filling pipe 170, and is sucked into the joint opening portion 612 communicating with the upper opening 178, The ink sucked into the joint opening portion 612 flows into the ink container 610 through the gap defined between the first valve element 641 and the fourth opening 651.

Through repetition of the operations described above with reference to FIG. 9 and FIG. 10, the main tank 132 can be substantially emptied of the ink filled into the main tank 132. After the operations of collecting the ink from the main tank 132 are finished, the second opening 653 is closed by the stopper 630, the ink collecting bottle 600 is removed from the ink filling pipe 170, and the joint opening portion 612 is hermetically sealed by the cap 660. In this manner, ink collection through use of the ink collecting bottle 600 is finished. Even when such ink collection is performed, a slight amount of the ink may be left at the bottom portion of the main tank 132. Through a suction and restoration operation performed on the recording head 211 side, the ink left at the bottom portion of the main tank 132 and the ink left in the ink supply path illustrated in FIG. 3 such as the tube 150 are sucked, thereby being capable of, preferably, completely emptying the main tank 132 of the ink.

Through the ink collection described above, according to the first embodiment, the main tank 132 is nearly emptied of the ink, thereby being capable of reliably preventing leakage of the ink at the time of secondary transport. Further, in the first embodiment, as described with reference to FIG. 6, the ink collecting bottle 600 is mounted to the main tank 132 in a method substantially the same as the method of mounting the ink bottle 500 to the main tank 132 when the ink is filled into the main tank 132. Further, in the first embodiment, the ink in the main tank 132 is collected by squeezing the ink container 610 with the fingers F. Accordingly, any complicated operation is not required. Further, there is an extremely low risk in that the fingers F of the user, a periphery of the main tank 132, and a periphery of the ink collecting bottle 600 are stained with the ink, thereby being capable of performing work safely and securely.

Second Embodiment

Figure 11:
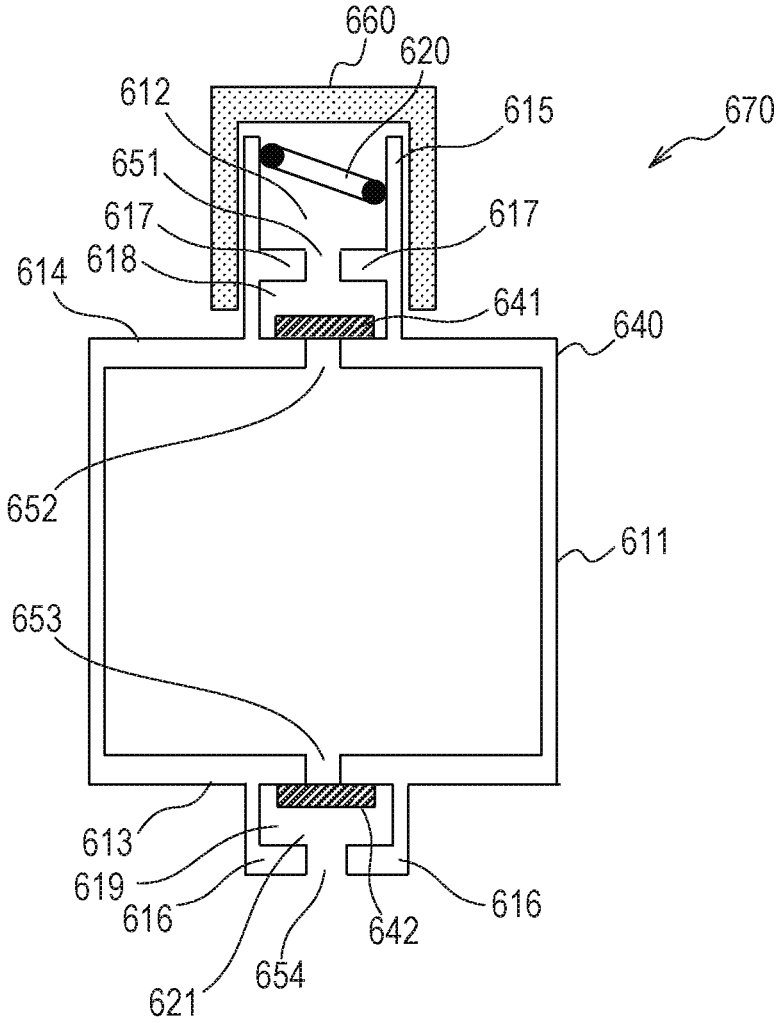
FIG. 11 is a view for schematically illustrating a cross section of a liquid collecting bottle according to a second embodiment.

Next, an ink collecting bottle being an example of the liquid collecting device according to a second embodiment is described with reference to FIG. 11, FIG. 11 is a sectional view for illustrating an ink collecting bottle 670.

(Ink Collecting Bottle)

The ink collecting bottle 670 of the second embodiment is different from the ink collecting bottle 600 (FIG. 7) of the first embodiment in view of structure regarding the following point. The difference is that a second valve element 642 and a bottom unit portion 616 are provided on the bottom portion 613 of an ink container 640 of the ink collecting bottle 670. The second valve element 642 is configured to close the second opening 653. The bottom unit portion 616 extends downward from the bottom portion 613 in the gravity direction, bends at right angles to the gravity direction, and then extends toward a center of the second opening 653. The bottom unit portion 616 is thus formed around the second opening 653 of the bottom portion 613 of the ink container 640, and defines; together with the ink container 640, a space 619 in which the second valve element 642 is received. With this configuration, a valve-element accommodating (or containing) portion 621 is formed. A third opening 654 is formed in the valve-element accommodating (or containing) portion 621 so as to communicate with the space 619, and the second valve element 642 is movable in a direction of connecting the second opening 653 and the third opening 654 to each other. The second valve element 642 is made of plastic having a specific gravity higher than that of the ink, and has an extremely thin disk shape. An area of the second valve element 642 is set to be larger than an opening area of the second opening 653 and an opening area of the third opening 654. For example, with a configuration in which a diameter of the disk of the second valve element 642 is set to be larger than a diameter of the second opening 653 and a diameter of the third opening 654, the second valve element 642 is prevented from coming into the ink container 640 or out of the third opening 654. Other components of the ink collecting bottle 670 have the same structure as that of the ink collecting bottle 600 of the first embodiment, and hence detailed description thereof is omitted.

Here, a method of manufacturing the ink collecting bottle 670 is briefly described. The ink container 640 and the joint unit portion 615 are manufactured in the same manner as that in the method of manufacturing the ink collecting bottle 600 (FIG. 7) of the first embodiment, and hence only differences are described. The second valve element 642 having a diameter large enough to close the second opening 653 is put beneath the second opening 653 of the ink container 640. Then, the bottom unit portion 616 is placed on and bonded to the ink container 640 such that a center of the bottom unit portion 616 is aligned with a center of the bottom portion 613 of the ink container 640.

(Ink Collecting Method)

Figure 12:
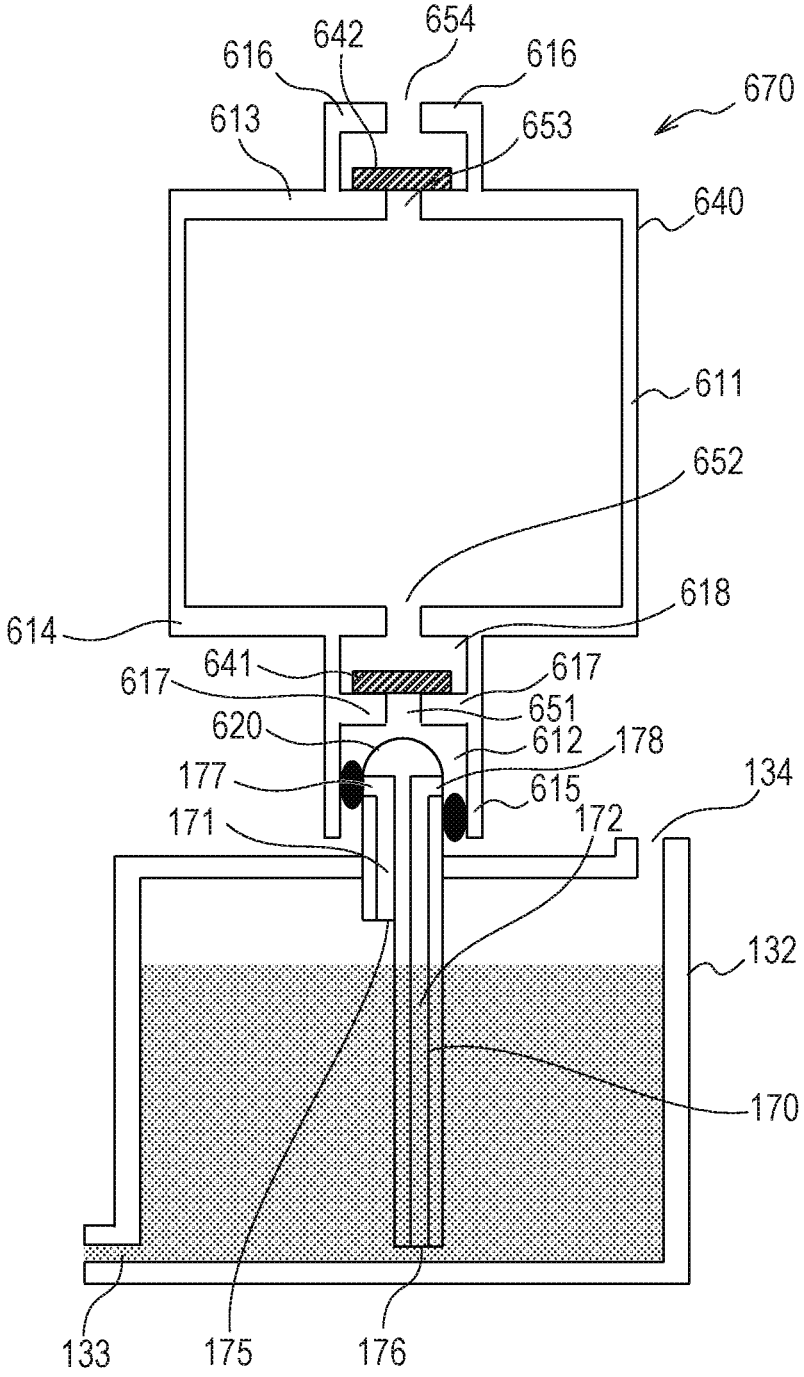
FIG. 12 is a schematic view for illustrating a state in which the liquid collecting bottle is mounted to the main tank so as to collect the liquid.
Figure 13:
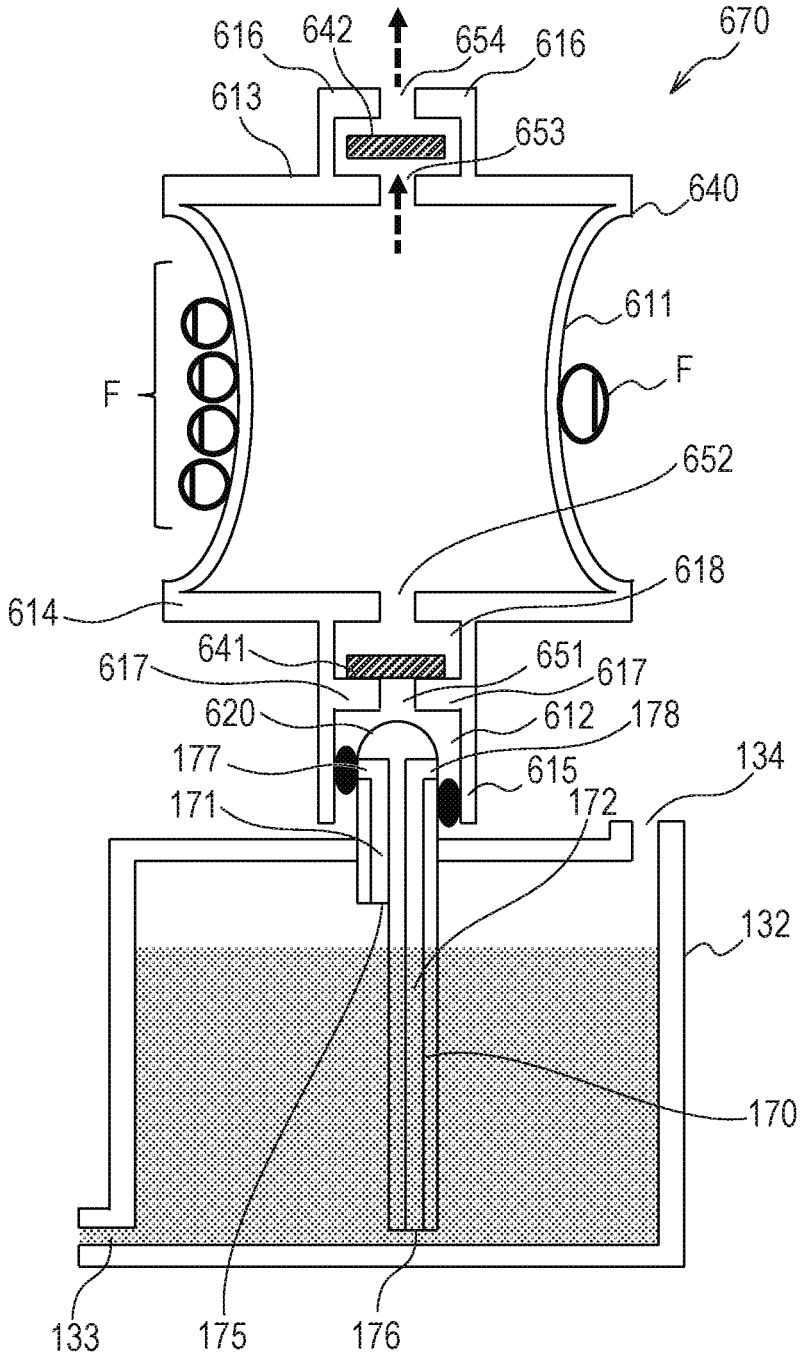
FIG. 13 is a schematic view for illustrating a state in which the liquid is collected from the main tank by squeezing side surfaces of the liquid collecting bottle.
Figure 14:
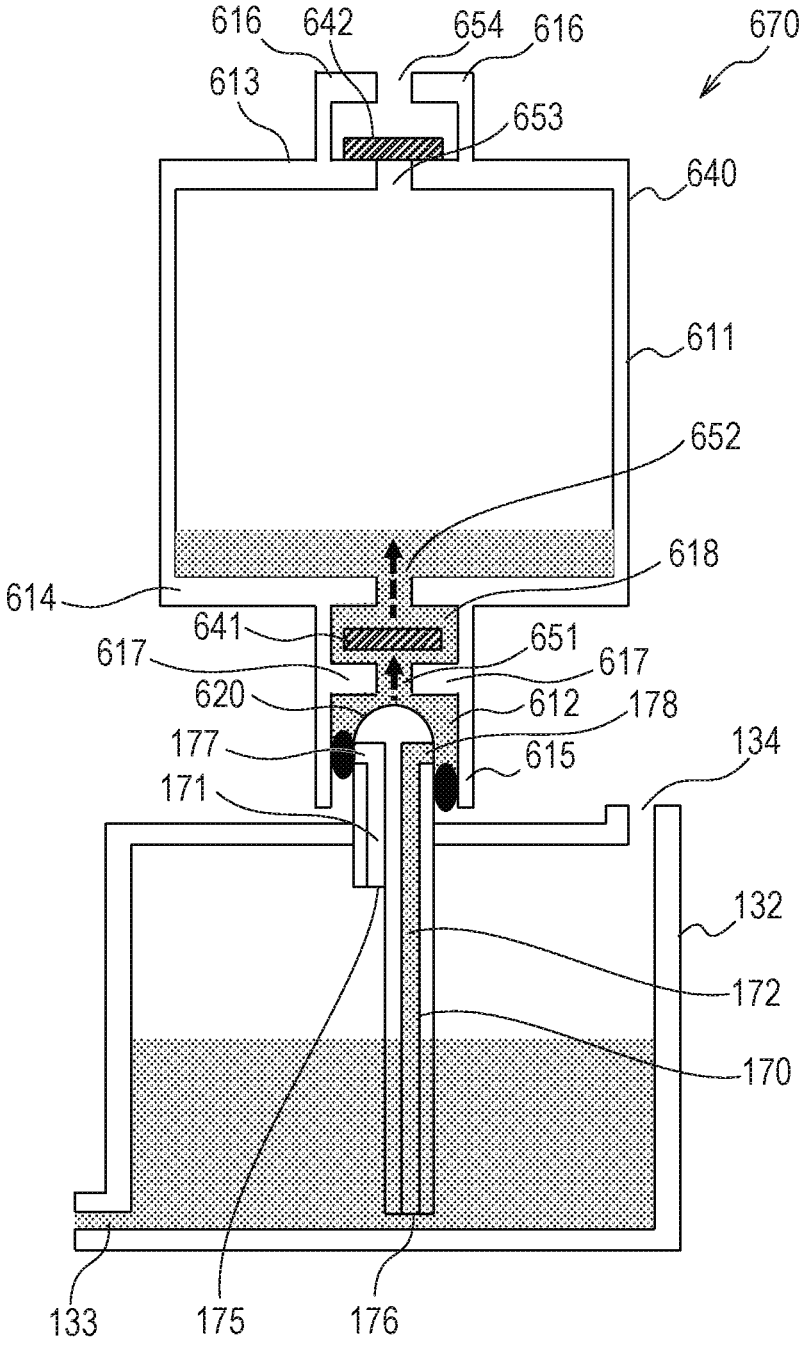
FIG. 14 is a schematic view for illustrating a state in which the liquid is collected after the liquid collecting bottle squeezed at the side surfaces returns to an original size.

Next, a method of collecting the ink through use of the ink collecting bottle 670 being an example of the liquid collecting device according to the second embodiment is described with reference to FIG. 12 to FIG. 14. FIG. 12 is a view for illustrating a state in which the ink collecting bottle 670 is mounted to the ink filling pipe 170 of the main tank 132. FIG. 13 is a view for illustrating a state in which the body portion 611 of the ink collecting bottle 670 is squeezed under the state illustrated in FIG. 12. FIG. 14 is a view for illustrating a state in which the body portion 611 of the ink collecting bottle 670 returns to the original shape through cancel of squeezing under the state illustrated in FIG. 13.

A method of mounting the ink collecting bottle 670 to the main tank 132 is carried out in the manner described in the first embodiment. Further, the ink collection illustrated in FIG. 12 is performed in the same manner as that in the case of FIG. 8 described in the first embodiment, and hence detailed description thereof is omitted.

Next, as illustrated in FIG. 13, a user squeezes the body portion 611 of the ink collecting bottle 670 with fingers F. When the user squeezes both side surfaces of the body portion 611 of the ink container 640 with the fingers F, the both side surfaces of the ink container 640 are squeezed so that an inner volume of the ink container 640 is reduced. At this time, gravity and pressure generated along with reduction in inner volume of the ink container 640 are applied to the first valve element 641 so that the first valve element 641 closes the fourth opening 651. Accordingly, along with reduction in inner volume after the ink container 640 is squeezed, the air in the ink collecting bottle 670 is vented through the second opening 653, a space along an outer periphery of the second valve element 642, which is defined when the second valve element 642 closing the second opening 653 by its own weight is raised, and the third opening 654. Therefore, along with reduction in inner volume after the ink container 640 is squeezed, the air in the ink collecting bottle 670 is released to the outside through the second opening 653 of the ink collecting bottle 670, the space along the outer periphery of the second valve element 642, and the third opening 654.

As described in the first embodiment with reference to FIG. 10, the user closes the second opening 653 with at least one finger F, thereby causing the ink to flow into the ink container 610 through use of the negative pressure generated in the ink container 610. In the second embodiment, as illustrated in FIG. 14, when the user releases the fingers F, with which the user squeezes the ink container 640, from the both side surfaces of the body portion 611 of the ink container 640, the both side surfaces of the body portion 611 of the ink container 640 return to the original shapes. The both side surfaces of the body portion 611 of the ink container 640 return the original shapes because the ink container 640 has the restoration force of returning to the original shape after being squeezed as described above. The main tank 132 has the atmosphere communicating port 134 through which the air in the atmosphere is taken in. Thus, the atmospheric pressure is applied to the inside of the main tank 132. In contrast, the second opening 653 is closed due to the own weight of the second valve element 642, and pressure (negative pressure) that is lower than the atmospheric pressure and applied to the inside of the ink container 640. Therefore, there is a difference in pressure between the inside of the ink container 640 and the inside of the main tank 132, and as indicated by the dotted arrows, the force of raising the first valve element 641 slightly upward in the gravity direction is applied to the first valve element 641. When the first valve element 641 is raised, a gap is defined between the first valve element 641 and the fourth opening 651. The ink in the main tank 132 passes through the liquid flow passage 172 and the upper opening 178 of the ink filling pipe 170, and is sucked into the joint opening portion 612 communicating with the upper opening 178. The ink sucked into the joint opening portion 612 flows into the ink container 610 through the gap defined between the first valve element 641 and the fourth opening 651.

Through repetition of the operations described above with reference to FIG. 13 and FIG. 14, the main tank 132 can be substantially emptied of the ink filled into the main tank 132. After the operations of collecting the ink from the main tank 132 are finished, the third opening 654 is closed by the stopper (not shown), the ink collecting bottle 670 is removed from the ink filling pipe 170, and the joint opening portion 612 is hermetically sealed by the cap 660. In this manner, ink collection through use of the ink collecting bottle 670 is finished.

In the second embodiment, through use of the negative pressure generated in the ink container 640, the second valve element 642 closes the second opening 653 completely, thereby causing the ink in the main tank 132 to flow into the ink container 640. According to the second embodiment, it is not required that the user close the second opening 653 with at least one finger F. As a result, squeezing of the body portion 611 of the ink container 640 and cancel of the squeezing can be carried out successively. Thus, the ink filled into the main tank 132 can be easily collected.

According to the second embodiment, the main tank 132 can be nearly emptied of the liquid. Along with this, leakage of the liquid at the time of secondary transport can be reliably prevented. Further, there is an extremely low risk in that the fingers F of the user, a periphery of the main tank 132, and a periphery of the ink collecting bottle 670 are stained with the ink, thereby being capable of performing work safely and securely.

Third Embodiment

Next, a liquid collecting and filling system according to a third embodiment is described with reference to FIG. 15A to FIG. 16B.

Figure 15A:
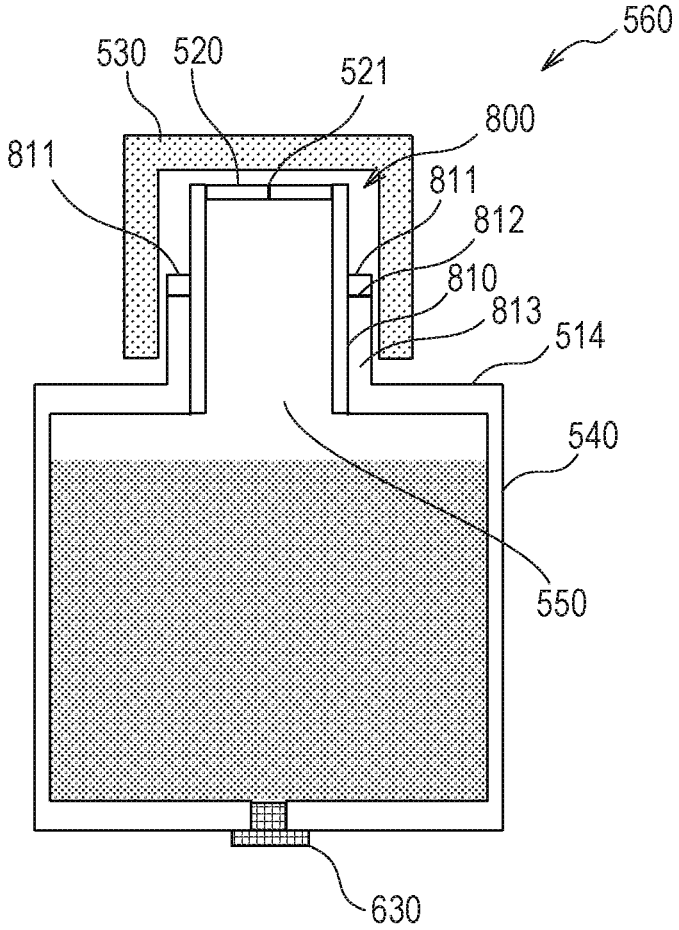
FIG. 15A is a schematic view for illustrating a cross section of a liquid bottle to which a liquid filling joint portion is mounted.
Figure 15B:
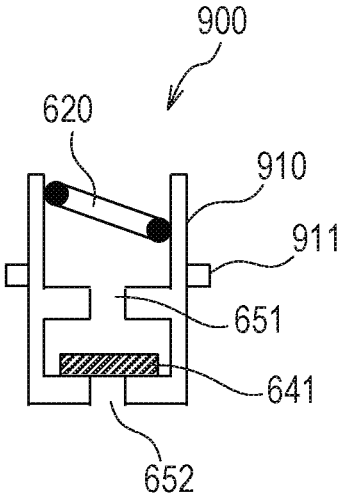
FIG. 15B is a schematic view for illustrating a cross section of a liquid collecting joint portion.
Figure 16A:
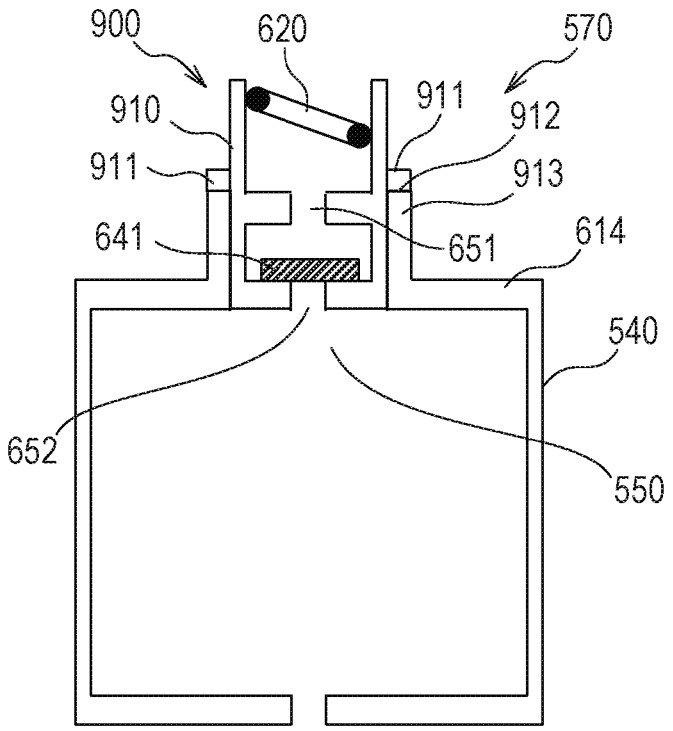
FIG. 16A is a schematic view for illustrating a cross section of the liquid bottle to which the liquid collecting joint portion is mounted.
Figure 16B:
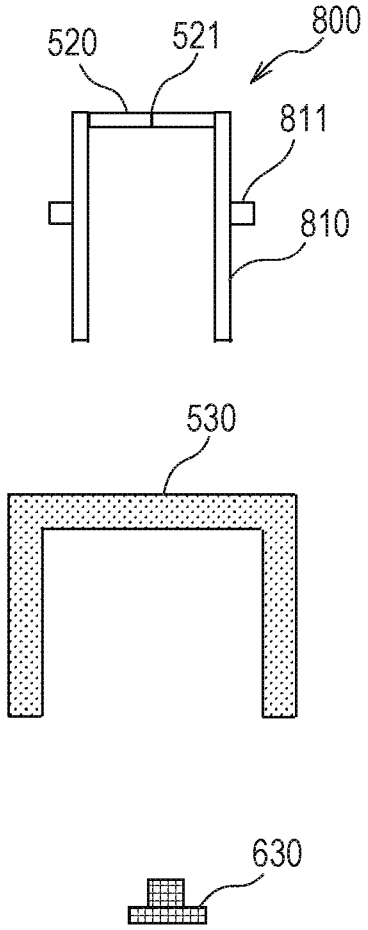
FIG. 16B is a schematic view for illustrating a cross section of the liquid filling joint portion, a cross section of a cap, and a cross section of a stopper.

FIG. 15A is a sectional view for illustrating a filling system 560 in which a filling joint portion 800, the cap 530, and the stopper 630 are mounted to an ink container 540 and the ink for filling is stored in the ink container 540. FIG. 15B is a sectional view for illustrating a collecting joint portion 900. FIG. 16A is a sectional view for illustrating a collecting system 570 under a state in which the collecting joint portion 900 of FIG. 15B is mounted to the ink container 540 after the ink in the filling system 560 of FIG. 15A is filled into the main tank and the filling joint portion 800 is removed from the ink container 540 emptied of the ink. FIG. 16B is a sectional view for illustrating the filling joint portion 800, the cap 530, and the stopper 630 removed from the ink container 540.

In the third embodiment, the following mode is described. As illustrated in FIG. 15A, the filling joint portion 800 of the ink filling system 560, which is to be connected to the main tank 132, has the removable structure. When the ink is required to be collected, the filling joint portion 800 is removed from the ink filling system 560, and the collecting joint portion 900 illustrated in FIG. 15B, which is separately provided, is mounted to the ink container 540. Thus, the collecting joint portion 900 and the ink container 540 are used as the ink collecting system 570 illustrated in FIG. 16A. In other words, a mode of reusing the ink container 540 is described.

In this mode, after the ink is collected, when the collecting joint portion 900 is replaced with the filling joint portion 800 again, the collected ink can be filled into the main tank 132 again.

As a mode of selling the liquid collecting and filling system, a mode of selling a set of the filling system of FIG. 15A and the collecting joint of FIG. 15B may be adopted. As a matter of course, a mode of independently selling the collecting joint of FIG. 15B may also be adopted.

Meanwhile, as illustrated in FIG. 16A, the collecting joint portion 900 of the ink collecting system 570 may have the removable structure. In this case, when the ink is required to be collected, the ink is collected under the state illustrated in FIG. 16A. Then, when the ink is filled, the collecting joint portion 900 is removed from the ink collecting system 570, and the filling joint portion 800 illustrated in FIG. 16B, which is separately provided, is mounted to the ink container 540. Thus, the filling joint portion 800 and the ink container 540 are used as the ink filling system illustrated in FIG. 15A.

In this mode, after the ink is collected, the collecting joint portion 900 is replaced with the filling joint portion 800, thereby using the filling joint portion 800 and the ink container 540 as the mode illustrated in FIG. 15A. Thus, the collected ink can be filled into the main tank 132 again.

As a mode of selling the liquid collecting and filling system illustrated in FIG. 16A, a mode of selling a set of the collecting system of FIG. 16A and the filling joint of FIG. 16B may be adopted. As a matter of course, a mode of independently selling the filling joint of FIG. 16B may also be adopted.

As described above, when the ink once collected is filled into the main tank 132 again, it is assumed that the collected ink is contaminated by, for example, foreign matters or dust. Accordingly, it is further preferred that a filter (not shown) be provided to the collecting joint portion 900 or the filling joint portion 800. It is still further preferred that the filter be provided to the filling joint because the ink finally filled into the main tank is filtered.

Now, description is made with reference to the drawings.

The ink filling system 560 illustrated in FIG. 15A has a mode in which the filling joint portion 800 illustrated in FIG. 15A and FIG. 16B has the independent configuration. The filling joint portion 800 includes an ink filling joint case 810 and a flange 811, and is removably fitted into an opening portion 550 of the ink container 540. In the ink filling joint case 810, the joint rubber member 520 having the slit 521 is provided at an end surface of the ink filling joint portion 800 that is to be coupled to the ink filling pipe 170.

The ink filling joint portion 800 has such a dimensional relationship as to be capable of being press-fitted into the opening portion 550 of the ink container 540. Further, the flange 811 has a function of regulating a position of inserting the ink filling joint portion 800 into the opening portion 550 of the ink container 540. The flange 811 is brought into abutment against a top surface 812 of a cylindrical wall 813 extending upward from an upper surface portion 514 of the ink container 540, thereby positioning the filling joint portion 800 with respect to the ink container 540.

The ink collecting joint portion 900 illustrated in FIG. 15B includes, at a portion to be coupled to the ink filling pipe 170 of the main tank 132, an ink collecting joint case 910 and a flange 911. The O-ring 620 is provided in the ink collecting joint case 910, and the fourth opening 651 and the first opening 652 are formed in the ink collecting joint case 910. The first valve element 641 is provided between the fourth opening 651 and the first opening 652.

The ink collecting joint portion 900 is press-fitted into the opening portion 550 of the ink container 540 from which the cap 530 and the ink filling joint portion 800 are removed, and is configured to regulate, through use of the flange 911, a position of inserting the ink collecting joint portion 900 into the opening portion 550 of the ink container 540. The flange 911 is brought into abutment against the top surface 812 of the cylindrical wall 813 extending upward from the upper surface portion 514 of the ink container 540, thereby positioning the collecting joint portion 900 with respect to the ink container 540.

According to the third embodiment, it is not required to prepare two kinds of bottles, specifically, an ink filling bottle and an ink collecting bottle, That is, when the ink filling portion and the ink collecting portion to be removably mounted to a bottle main body are prepared, one bottle main body can have both an k filling function and an ink collecting function.

Further, in the ink collecting bottle described above in the first and second embodiments, it is not assumed that the collected ink is reused. However, in the third embodiment, the collected ink can be reused. That is, after the ink is collected from the main tank 132 through use of the ink collecting system 570 illustrated in FIG. 16A, the cap 530 and the stopper 630 are mounted to the ink collecting system 570. Thus, the collected ink is stored. After that, when the stored ink is reused, the cap 530 and the ink collecting joint portion 900 are removed from the ink collecting system 570, and the ink filling joint portion 800 is mounted to the ink container 540. Thus, the ink can be filled into the main tank 132 described with reference to FIG. 6. In this manner, through reuse of the collected ink, waste of the ink accompanied with discard thereof can be reduced. Further, there is an advantage in that the collected ink is reusable after secondary transport.

As described above, according to the present disclosure, there can be provided a liquid collecting device and a liquid collecting and filling system; which are capable of reliably collecting the liquid through use of a dedicated collecting system when collecting the liquid from the main tank in a case in which secondary transport is required, and capable of more reliably preventing leakage of the liquid at the time of collection or transport.

Further, the joint portion of the collecting system is configured to be replaceable with the joint portion of the filling system. Accordingly, the liquid collecting and filling system capable of reusing the ink container can be provided.

Embodiment(s) of the present disclosure can also be realized by a computer of a system or apparatus that reads out and executes computer executable instructions (one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (MID), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No, 2019-139477, filed Jul. 30, 2019, and Japanese Patent Application No. 2020-108914, filed Jun. 24, 2020, which are hereby incorporated by reference herein in their entirety.

What is claimed is:

1. A liquid collecting device configured to collect liquid stored in a storage portion of a liquid container, wherein the liquid collecting device is connected to the liquid container, which includes a flow passage member configured to allow the liquid to be filled into the storage portion, the liquid collecting device comprising:

a bottle main body having an elastic restoration force and having first and second openings configured to be in communication with an outside of the liquid collecting device;

a collecting joint portion connected to the bottle main body through the first opening, wherein the collecting joint portion includes a first coupling portion configured to be coupled to the flow passage member, and includes an internal flow passage extending between the first opening and the first coupling portion, wherein the internal flow passage includes a throttle portion and a space defined between the first opening and the throttle portion; and a first valve element provided in the space so as to be movable in a flowing direction of the liquid, wherein the first valve element has a first area larger than an opening area of the first opening and an opening area of the throttle portion.

2. The liquid collecting device according to claim 1, wherein the flow passage member has an air flow passage configured to allow air to pass there through and a liquid flow passage configured to allow the liquid to flow there through, and wherein the collecting joint portion further includes a control member configured to close the air flow passage and keep the liquid flow passage open when the flow passage member is coupled to the first coupling portion.

3. The liquid collecting device according to claim 2, wherein the control member includes an O-ring provided so as to be inclined with respect to a center axis of the internal flow passage, and wherein an opening of the air flow passage opened toward the internal flow passage and an opening of the liquid flow passage opened toward the internal flow passage are at the same position in a direction of the center axis of the internal flow passage.

4. The liquid collecting device according to claim 2, wherein the air flow passage extends from an upper side of the storage portion to an upper portion of the storage portion, and wherein the liquid flow passage extends from the upper side of the storage portion to a vicinity of a bottom portion of the storage portion.

5. The liquid collecting device according to claim 1, further comprising a second valve element configured to close or open the second opening, wherein the second valve element is configured to open the second opening when a pressing force is applied to the bottle main body, and to close the second opening when the pressing force is lost.

6. The liquid collecting device according to claim 5, further comprising a valve-element accommodating portion formed around the second opening of the bottle main body, wherein, the valve-element accommodating portion and the bottle main body together defines a space in which the second valve element is received, wherein the valve-element accommodating portion has a third opening configured to be in communication with the space, wherein the second valve element is provided so as to be movable in a direction of connecting the second opening and the third opening to each other, and wherein the second valve element has a second area larger than an opening area of the second opening and an opening area of the third opening.

7. A liquid collecting and filling system comprising:

a liquid collecting device configured to collect liquid stored in a storage portion of a liquid container, wherein the liquid collecting device is connected to the liquid container, which includes a flow passage member configured to allow the liquid to be filled into the storage portion, wherein the liquid collecting device includes:

a bottle main body having an elastic restoration force and having first and second openings configured to be in communication with an outside of the liquid collecting device, a collecting joint portion connected to the bottle main body through the first opening, wherein the collecting joint portion includes a first coupling portion configured to be coupled to the flow passage member, and includes an internal flow passage extending between the first opening and the first coupling portion, wherein the internal flow passage includes a throttle portion and a space defined between the first opening and the throttle portion, and a first valve element provided in the space so as to be movable in a flowing direction of the liquid, wherein the first valve element has a first area larger than an opening area of the first opening and an opening area of the throttle portion; and a filling joint portion removably connected to the bottle main body in place of the collecting joint portion when the liquid is filled into the liquid container, wherein the filling joint portion is removably mounted to the bottle main body, wherein the filling joint portion includes a second coupling portion to be coupled to the flow passage member, and wherein the second coupling portion includes a sealing member into which the flow passage member is insertable.

8. The liquid collecting and filling system according to claim 7, further comprising a regulating member configured to position the collecting joint portion or the filling joint portion when the collecting joint portion or the filling joint portion is connected to the bottle main body.

9. The liquid collecting and filling system according to claim 8, wherein the regulating member includes a flange formed on each of an outer peripheral surface of the collecting joint portion and an outer peripheral surface of the filling joint portion, and a circumferential wall extending upward from an upper surface of the bottle main body and including a top surface to be brought into abutment against the flange.

* * * * *